United States Patent [19]

Kimball, III et al.

[11] 4,189,657

[45] Feb. 19, 1980

[54] METHOD OF MAKING SEALED BEAM LAMP

[75] Inventors: Stephen F. Kimball, III, Andover; Robert P. Bonazoli, Hamilton; Lewis H. Palmer, III, Marblehead, all of Mass.

[73] Assignee: GTE Sylvania Incorporated, Stamford, Conn.

[21] Appl. No.: 897,999

[22] Filed: Apr. 20, 1978

[51] Int. Cl.[2] ..... H01J 5/16; H01J 61/40; H01K 1/26; H01K 1/30

[52] U.S. Cl. ..... 313/113; 313/315; 29/25.16; 362/37

[58] Field of Search ..... 313/113, 315, 318; 362/37; 29/25.16

[56] References Cited

U.S. PATENT DOCUMENTS

| | | | |
|---|---|---|---|
| 2,689,924 | 9/1954 | Honing et al. | 313/113 |
| 2,870,362 | 1/1959 | Arnold et al. | 313/113 |
| 2,890,920 | 6/1959 | Falge | 313/113 X |
| 3,904,904 | 9/1975 | Meinecke et al. | 313/113 |
| 3,909,607 | 9/1975 | Vause et al. | 313/113 |
| 3,936,686 | 2/1976 | Moore | 313/113 |
| 3,997,808 | 12/1976 | Wojtowicz | 313/113 |

*Primary Examiner*—Saxfield Chatmon, Jr.
*Attorney, Agent, or Firm*—James Theodosopoulos

[57] ABSTRACT

A tungsten-halogen lamp capsule is disposed within a curved reflector, the lead-in support wires for the capsule protruding through the rear portion of the reflector. After a front lens is sealed to the reflector, the lamp is energized and the beam pattern is adjusted by moving the support wires relative to the reflector. When the desired pattern is obtained, the wires are secured to the reflector.

6 Claims, 3 Drawing Figures

METHOD OF MAKING SEALED BEAM LAMP

BACKGROUND OF THE INVENTION

This invention is concerned with electric lamps which comprise a tungsten-halogen lamp within a reflector envelope for use, for example, in motor vehicle headlights. Examples of motor vehicle headlights are shown in U.S. Pat. Nos. 3,974,413 and 4,011,642. In the former, there is only one envelope, the reflector envelope itself, and the tungsten filament is disposed therein. In the latter, the tungsten filament is disposed within a small halogen-containing envelope, called a capsule, which is itself disposed within the reflector envelope. In neither case is it possible to adjust the position of the filament relative to the reflector, after the front lens is sealed to the reflector. The purpose of this invention is to provide for such an adjustment, since it results in more accurate focussing than do prior art methods.

SUMMARY OF THE INVENTION

In this invention, a curved reflector is provided which has small holes through the rear portion thereof, through which lead-in support wires may extend. Copending application Ser. No. 883,863, filed Mar. 6, 1978, same assignee, which is incorporated herein by reference, shows such a reflector having metal eyelets fastened to the rear portion thereof and a lead-in support wire extending through a hole in each eyelet.

A tungsten-halogen capsule, such as is shown in copending application Ser. No. 886,252, filed Mar. 13, 1978, same assignee, the disclosure of which is incorporated herein by reference, is disposed within the curved reflector, with the lead-in support wires for the capsule loosely extending through the holes in the rear portion of the reflector.

A front lens is then sealed to the reflector, and the assembly is mounted on a focussing apparatus where the capsule can be accurately positioned within the reflector by adjustment of the externally protruding lead-in support wires. The lead-in support wires are then secured to the reflector and the excess length of the wires can be cut off.

DESCRIPTION OF THE PREFERRED EMBODIMENT

Figure 1:
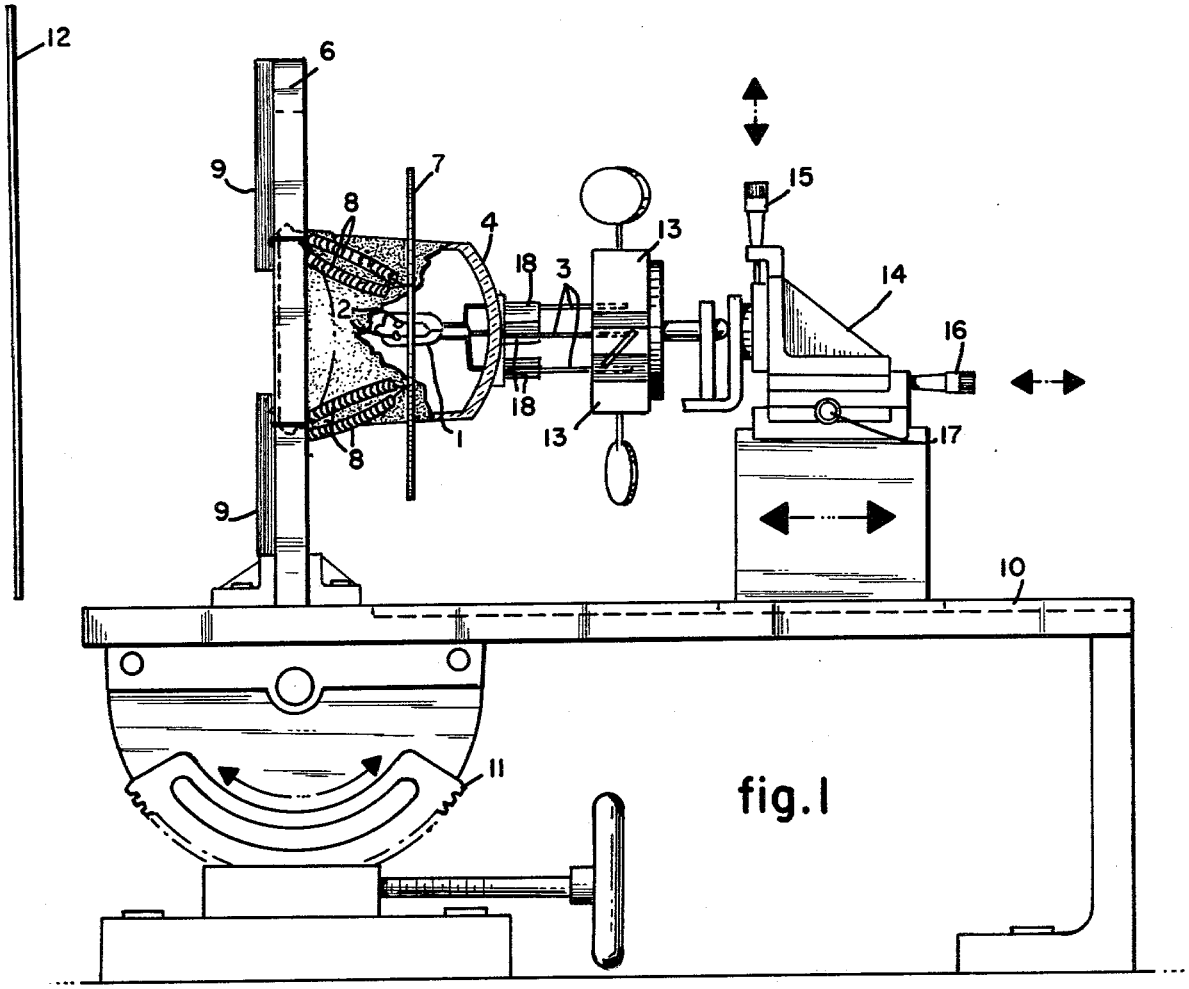
FIG. 1 is an elevational view of focussing apparatus that can be used with the invention, showing the lamp clamped in place, the lamp reflector being partly broken to show the tungsten halogen capsule.
Figure 2:
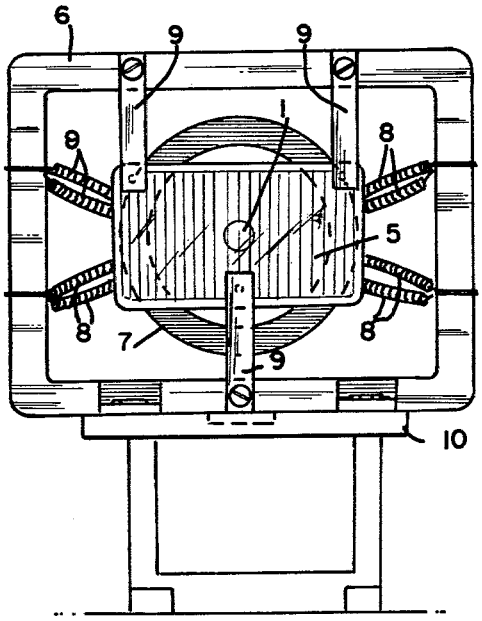
FIG. 2 is a front view of the lamp clamped in the focussing apparatus.
Figure 3:
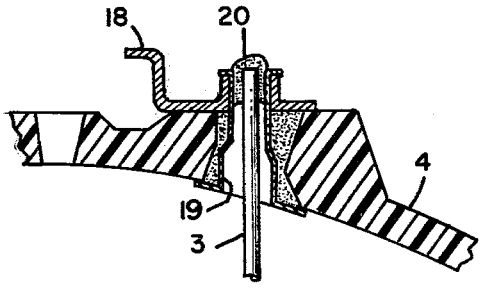
FIG. 3 is an expanded sectional view showing a lead-in support wire sealed to a metal sleeve of the reflector.

A sealed tungsten-halogen capsule 1 is provided which contains a gaseous fill including halogen and two tungsten filaments 2. The two filaments are connected to three lead-in support wires 3. If capsule 1 were to contain only one tungsten filament, such as for use in a high beam headlight, there would be only two lead-in support wires 3. Lead-in support wires 3 extend through clearance holes in sleeves 19 fastened to the rear portion of reflector 4.

After capsule 1 is disposed within reflector 4 with lead-in support wires 3 extending through the back of reflector 4, front lens 5 is adhesively sealed to the front of reflector 4. The lens-reflector assembly is then clamped to frame 6 by means of retainer ring 7 slipped over the rear of reflector 4. Retainer ring 7 engages reflector 4 and is pulled against frame 6 by springs 8. Three node locators 9 on frame 6 bear against three nodes on the front of lens 5 and provide a reference plane for the subsequent alignment and focussing of the headlight. The focussing apparatus is supported on a platform 10. Frame 6 is fastened to an adjustment device 11 below platform 10 which permits the reference plane to be made exactly parallel to the screen 12 on which the beam pattern will be projected.

Lead-in support wires 3 are clamped in a holder 13 which is fastened to a manipulator 14. One of the filaments 2 is electrically energized at rated voltage by means of electrical connections in holder 13, and its beam pattern is projected onto screen 12. The pattern is analyzed and can be adjusted to comply, for example, with SAE specification J579c entitled "Sealed Beam Headlamp Units for Motor Vehicles", by adjusting three micrometers 15, 16 and 17 on manipulator 14. Micrometer 15 provides for vertical movement of capsule 1 within reflector 4. Micrometer 16 provides for horizontal forward-and-rearward movement and micrometer 17 provides for horizontal sidewise movement, of capsule 1 within reflector 4. When the correct beam pattern is obtained, lead-in support wires 3 are secured to reflector 4 by, for example, soldering them to sleeves 19, or by soldering them to lugs 18 which are fastened to sleeves 19. The excess length of wires 3 beyond solder joint 20 is then cut off. It is the construction of a sealed beam lamp as per this invention that permits the position of capsule 1 to be adjusted after lens 5 is secured to reflector 4. This construction includes metal sleeves 19, which can be eyelets or ferrules, sealingly fastened to reflector 4, with clearance holes through sleeves 19, so that when lead-in support wires 3 extend therethrough, there is enough clearance around wires 3 to permit the adjustment of capsule 1. The clearance holes should be small enough, however, to be quickly sealed in an electrically conductive manner, such as by soldering or brazing of wire 3 to sleeve 19, when capsule 1 has been adjusted to the proper position and is held in the position during the sealing step by holder 13.

Prior art sealed beam lamps do not disclose such a construction. Generally, when ferrules were used, the lead-in support wires did not extend through the ferrules but were brazed thereto from the front of the reflector, before the front lens was attached. Focussing was accomplished before attachment of the front lens.

In those lamps where the lead-in support wires did extend through and beyond the reflector, the wires were sealed by a glass-to-metal type of seal, which does not provide an electrical connection as does this invention. Also, such a seal was generally made in the open reflector, front lens unattached, in order to permit the filament to be focussed prior to attachment of the front lens. In our invention, electrically conductive seal 20 is an external seal, that is to say, it is made from the back of reflector 4, after front lens 5 is attached and after capsule 1 has been focussed.

We claim:

1. The method of making an electric lamp, which comprises a tungsten-halogen lamp within a reflector envelope, comprising the steps of: disposing a tungsten-halogen lamp capsule within a curved reflector, the filament or filaments of the lamp capsule being connected to lead-in support wires which protrude rearwardly through holes in the reflector; sealing a front lens to the reflector; mounting the assembly in a focussing apparatus; energizing the filament; moving the support wires relative to the reflector in order to adjust the position of the capsule within the reflector in order to obtain a desired beam pattern; and fixing the capsule in said position by securing the lead-in support wires to the reflector.

2. The method of claim 1 wherein the lead-in support wires extend through holes in sleeves which are secured to the reflector.

3. The method of claim 2 wherein the capsule is fixed in said position by soldering the lead-in support wires to said sleeves.

4. The method of claim 1 including the step of cutting off the excess length of the lead-in support wires after they are secured to the reflector.

5. A sealed beam lamp comprising: an envelope comprising a curved reflector having a front lens attached thereto and metal sleeves attached to the reflector at the rear thereof; a tungsten-halogen capsule disposed in the envelope; lead-in support wires for the capsule extending through the reflector and through clearance holes in the metal sleeves, the lead-in support wires to the metal sleeves being an electrically conductive seal, said seal being made after the front lens has been attached to the reflector and after the capsule has been focussed.

6. An electric lamp comprising a tungsten halogen lamp within a reflector envelope made by the process of claim 1.

* * * * *